US011035258B2

(12) United States Patent
Schuster et al.

(10) Patent No.: US 11,035,258 B2
(45) Date of Patent: Jun. 15, 2021

(54) MODEL-BASED MONITORING OF THE OPERATING STATE OF AN EXPANSION MACHINE

(71) Applicant: ORCAN ENERGY AG, Munich (DE)

(72) Inventors: Andreas Schuster, Tussenhausen (DE); Roy Langer, Langenau (DE); Jens-Patrick Springer, Munich (DE); Fabian Weigand, Munich (DE)

(73) Assignee: ORCAN ENERGY AG, München (DE)

( * ) Notice: Subject to any disclaimer, the term of this patent is extended or adjusted under 35 U.S.C. 154(b) by 0 days.

(21) Appl. No.: 16/495,088

(22) PCT Filed: Nov. 22, 2017

(86) PCT No.: PCT/EP2017/080029

§ 371 (c)(1),
(2) Date: Sep. 17, 2019

(87) PCT Pub. No.: WO2018/166642

PCT Pub. Date: Sep. 20, 2018

(65) Prior Publication Data

US 2020/0095897 A1 Mar. 26, 2020

(30) Foreign Application Priority Data

Mar. 17, 2017 (EP) ..... 17161565

(51) Int. Cl.
*F01K 13/02* (2006.01)
*F01K 25/08* (2006.01)
(Continued)

(52) U.S. Cl.
CPC ..... *F01K 13/02* (2013.01); *F01K 25/08* (2013.01); *F01D 15/10* (2013.01); *F01K 9/003* (2013.01); *F01K 23/065* (2013.01); *F01K 23/10* (2013.01)

(58) Field of Classification Search
CPC . F01K 23/14; F01K 7/025; F01K 7/04; F01K 25/06; F01K 23/10; F01K 13/02; F01K 15/02; B60H 1/3222
See application file for complete search history.

(56) References Cited

U.S. PATENT DOCUMENTS

2005/0247059 A1* 11/2005 Cogswell ..... F01K 25/08 60/645
2011/0308252 A1* 12/2011 Kopecek ..... F22G 5/00 60/653

(Continued)

FOREIGN PATENT DOCUMENTS

DE 102014206033 A1 10/2015
EP 1759094 BI 4/2013
WO 2011093854 A1 8/2011

OTHER PUBLICATIONS

International Search Report issued by the European Patent Office Action for International Patent Application No. PCT/EP2017/080029 dated Jan. 4, 2018.

(Continued)

*Primary Examiner* — Shafiq Mian
(74) *Attorney, Agent, or Firm* — Moore & Van Allen PLLC; Henry B. Ward, III

(57) ABSTRACT

The invention refers to a method for controlling a thermodynamic cycle process apparatus, in particular an ORC apparatus, wherein the thermodynamic cycle process apparatus comprises an evaporator, an expansion machine, a condenser and a feed pump, and the expansion machine is coupled to an external apparatus in normal operation, and (Continued)

wherein the method comprises the following steps: measuring an exhaust steam pressure downstream of the expansion machine; and setting a volume flow of the feed pump in accordance with a computer-implemented control model of the thermodynamic cycle process apparatus according to the measured exhaust steam pressure and a target rotational speed of the expansion machine as input variables of the control model and with the volume flow of the feed pump as an output variable of the control model. The invention further refers to a corresponding thermodynamic cycle process apparatus.

20 Claims, 5 Drawing Sheets

(51) Int. Cl.

| | |
|---|---|
| *F01D 15/10* | (2006.01) |
| *F01K 9/00* | (2006.01) |
| *F01K 23/06* | (2006.01) |
| *F01K 23/10* | (2006.01) |

(56) References Cited

U.S. PATENT DOCUMENTS

| | | | | |
|---|---|---|---|---|
| 2014/0050560 | A1* | 2/2014 | Schuster | F04C 29/028 415/1 |
| 2014/0224469 | A1 | 8/2014 | Mirmobin et al. | |
| 2016/0251983 | A1* | 9/2016 | Schuster | F01K 25/08 60/646 |
| 2018/0209307 | A1* | 7/2018 | Aumann | F01K 7/025 |
| 2018/0245788 | A1* | 8/2018 | Ohman | F01K 25/04 |

OTHER PUBLICATIONS

Written Opinion issued by the European Patent Office Action for International Patent Application No. PCT/EP2017/080029 dated Jan. 4, 2018.

International Preliminary Report on Patentability issued by the European Patent Office Action for International Patent Application No. PCT/EP2017/080029 dated Sep. 17, 2019.

* cited by examiner

MODEL-BASED MONITORING OF THE OPERATING STATE OF AN EXPANSION MACHINE

FIELD OF THE INVENTION

The invention refers to a method for operating a thermodynamic cycle process apparatus, in particular an Organic Rankine Cycle (ORC) apparatus with an expansion machine and a thermodynamic cycle process apparatus which can be operated with the method according to the invention.

STATE OF THE ART

If a thermodynamic cycle process apparatus, for example an Organic Rankine Cycle apparatus, is coupled to a generator or a motor/generator unit in order to feed energy into a power grid, the expansion machine is subjected to speeds due to the grid frequency. A similar situation occurs when coupling with another external apparatus, such as a device with a combustion engine, to support it.

It has turned out that, for example, a coupling process of the external apparatus can cause damage to the expansion machine of the thermodynamic cycle process apparatus, especially in the bearing of the rotating elements of the expansion machine. According to the applicant's experience, this damage occurs when power is effectively supplied to the expansion machine. This applies in particular to screw expansion machines.

A coupling of a generator operated with an ORC system is described in EP 1759094 B1. Coupling to the power grid occurs when the measured generator speed matches the grid frequency, which therefore implies a power-free coupling. This speed measurement, however, represents an additional cost or, in the case of (semi-) hermetic machines, is even extremely expensive because the shaft is not directly accessible from the outside. Speed measurement based on the generated voltage is not possible with asynchronous generators that are not connected to the grid or otherwise not magnetized.

DESCRIPTION OF THE INVENTION

The object of the invention is to avoid the aforementioned disadvantages.

The invention describes the solution to the above problem by adding model-based control and/or monitoring to the operation (starting process, normal operation, shutdown) of the thermodynamic cycle process apparatus with the expansion machine.

The solution according to the invention is defined by a method with the features set out in claim 1.

The invention thus discloses a method for controlling a thermodynamic cycle process apparatus, in particular an ORC device, wherein the thermodynamic cycle process apparatus comprises an evaporator, an expansion machine, a condenser and a feed pump, and the expansion machine is coupled to an external apparatus in normal operation, and wherein the method comprises the following steps: measuring an exhaust steam pressure downstream of the expansion machine; and adjusting a volume flow of the feed pump in accordance with a computer-implemented control model of the thermodynamic cycle process apparatus as a function of the measured exhaust steam pressure and a target rotational speed of the expansion machine as input variables of the control model and with the volume flow of the feed pump as output variable of the control model.

The exhaust steam pressure downstream of the expansion machine can be measured between the expansion machine and the feed pump, especially between the expansion machine and the condenser or between the condenser and the feed pump. When measuring between the condenser and the feed pump, the pressure loss of the condenser can either be neglected or it is known and taken into account in the control.

Only the measured exhaust steam pressure or a measured value of the exhaust steam pressure corrected by a correction value is used as input variable in the control model (except for the target rotational speed of the expansion machine). When measuring the exhaust steam pressure between condenser and feed pump, a pressure loss of the condenser and/or pipelines between the expansion machine and the measuring point can be taken into account and the measured exhaust steam pressure corrected accordingly.

The volume flow of the working medium pumped by the feed pump can be controlled in various ways. Setting the speed of the feed pump is one way of adjusting the volume flow of the feed pump, other ways would be a throttle (throttle valve) or a 3-way valve downstream of the pump or adjusting the feed characteristics of the feed pump by adjusting a guide wheel or a piston stroke.

The advantage of the method according to the invention is that the measuring point for the speed measurement required according to the state of the art can be avoided with the help of the model-based control within the scope of the present invention.

The method according to the invention can be further developed in such a way that a starting process of the thermodynamic cycle process apparatus can include the following steps: controlling the expansion machine to a state in which the target rotational speed of the expansion machine is greater than or equal to a predetermined speed of the external apparatus to be coupled to the expansion machine, the external apparatus to be coupled comprising in particular a generator, a generator/motor unit or a device driven by a separate motor; and subsequently coupling the expansion machine to the external apparatus. If the speeds are the same, a power-neutral coupling takes place. If the speed of the expansion device at coupling is (slightly) higher than a synchronous speed, then the effective power of the expansion machine is positive and therefore does not damage the bearings.

Another further development is that the following further steps can be carried out: measuring the live steam pressure upstream of the expansion engine; comparing the measured live steam pressure with a current model live steam pressure according to the control model; and initiating a shutdown process and/or aborting the starting process if the measured live steam pressure is more than a predetermined amount or more than a predetermined fraction below the model live steam pressure which depends on the measured exhaust steam pressure.

The live steam pressure upstream of the expansion machine can be measured between the feed pump and the expansion machine, in particular between the evaporator and the expansion machine or between the feed pump and the evaporator. The live steam pressure could, for example, be measured at the outlet of the feed pump/inlet of the evaporator and corrected for the pressure loss of the evaporator and/or the piping to the inlet of the expansion machine.

This can be further developed to the effect that during the starting process the expansion engine is coupled to the external apparatus only if the measured live steam pressure is greater than or equal to the model live steam pressure.

According to another further development, the following further steps can be carried out: measuring a heat source temperature of a heat source supplying heat to the thermodynamic cycle process apparatus via the evaporator; and starting only if the measured heat source temperature is greater than or equal to a current model heat source temperature according to the control model.

Another further development is that a shutdown of the thermodynamic cycle process apparatus may include the following steps: decoupling the expansion machine from the external apparatus if the live steam pressure and/or the heat source temperature fall below a respective predetermined threshold; and opening a bypass line to bypass the expansion machine.

This can be further developed so that the next step is still carried out: reducing the volume flow (in particular by reducing the rotational speed) of the feed pump until a power-neutral or force-free state of the expansion device is achieved according to the control model, in which the power consumed by the expansion device is equal to the power output by the expansion device or the total force acting on the expansion device in the direction of an axis of rotation of the expansion device is equal to zero.

The control model according to the invention can include analytical and/or numerical and/or tabular relations of the input and output variables.

The above object is also solved by a thermodynamic cycle process apparatus according to claim 10.

The thermodynamic cycle process apparatus according to the invention (in particular an ORC device) comprises an evaporator, an expansion machine, a condenser, and a feed pump, wherein the expansion machine is coupled to an external apparatus during normal operation; wherein the thermodynamic cycle process apparatus further comprises: an exhaust steam pressure measuring device for measuring an exhaust steam pressure downstream of the expansion machine; and a control device for setting a volume flow of the feed pump in accordance with a control model of the thermodynamic cycle process apparatus stored in a memory of the control device as a function of the measured exhaust steam pressure and a target rotational speed of the expansion machine as input variables of the control model and with the volume flow of the feed pump as output variable of the control model. The exhaust steam pressure downstream of the expansion machine can be measured at the points mentioned above in connection with the method according to the invention.

The thermodynamic cycle process apparatus according to the invention can be further developed to the effect that the control device is designed to perform the following steps during a starting process of the thermodynamic cycle process apparatus: controlling the expansion machine to a state in which the target rotational speed of the expansion machine is greater than or equal to a predetermined speed of the external apparatus to be coupled to the expansion machine, the external apparatus to be coupled comprising in particular a generator, a generator/motor unit or a device driven by a separate motor; and subsequently coupling the expansion machine to the external apparatus.

According to another development, the thermodynamic cycle process apparatus further comprises a live steam pressure measuring device for measuring a live steam pressure upstream of the expansion machine; the control device being adapted to compare the measured live steam pressure with a current model live steam pressure according to the control model, and to initiate a shutdown process and/or abort a starting process if the measured live steam pressure is more than a predetermined amount or more than a predetermined fraction below the model live steam pressure. The live steam pressure upstream of the expansion machine can be measured at the points already mentioned above in connection with the method according to the invention.

Another further development is that the thermodynamic cycle process apparatus further comprises: a heat source temperature measuring device for measuring a heat source temperature of a heat source supplying heat to the thermodynamic cycle process apparatus via the evaporator; wherein the control device is adapted to perform the starting process only when the measured heat source temperature is greater than or equal to a current model heat source temperature according to the control model.

According to another further development, the thermodynamic cycle process apparatus further comprises a bypass line as a direct connection between the evaporator and the condenser for bypassing the expansion machine; the control device being adapted to perform the following steps during a shutdown operation of the thermodynamic cycle process apparatus: decoupling the expansion machine from the external apparatus if the live steam pressure and/or the heat source temperature fall below a respective predetermined threshold; and opening the bypass line by means of a valve in the bypass line.

Another further development is that the thermodynamic cycle process apparatus further comprises: a coupling for coupling the expansion apparatus to the external apparatus; and/or a gear for adjusting a speed ratio from the expansion apparatus to the external apparatus.

The further developments mentioned can be used individually or combined as required.

Further features and exemplary embodiments as well as advantages of this invention are explained in more detail below using the drawings. It goes without saying that the embodiments do not exhaust the scope of this invention. It also goes without saying that some or all of the features described below can be combined in other ways.

DRAWINGS

EMBODIMENTS

Figure 1:
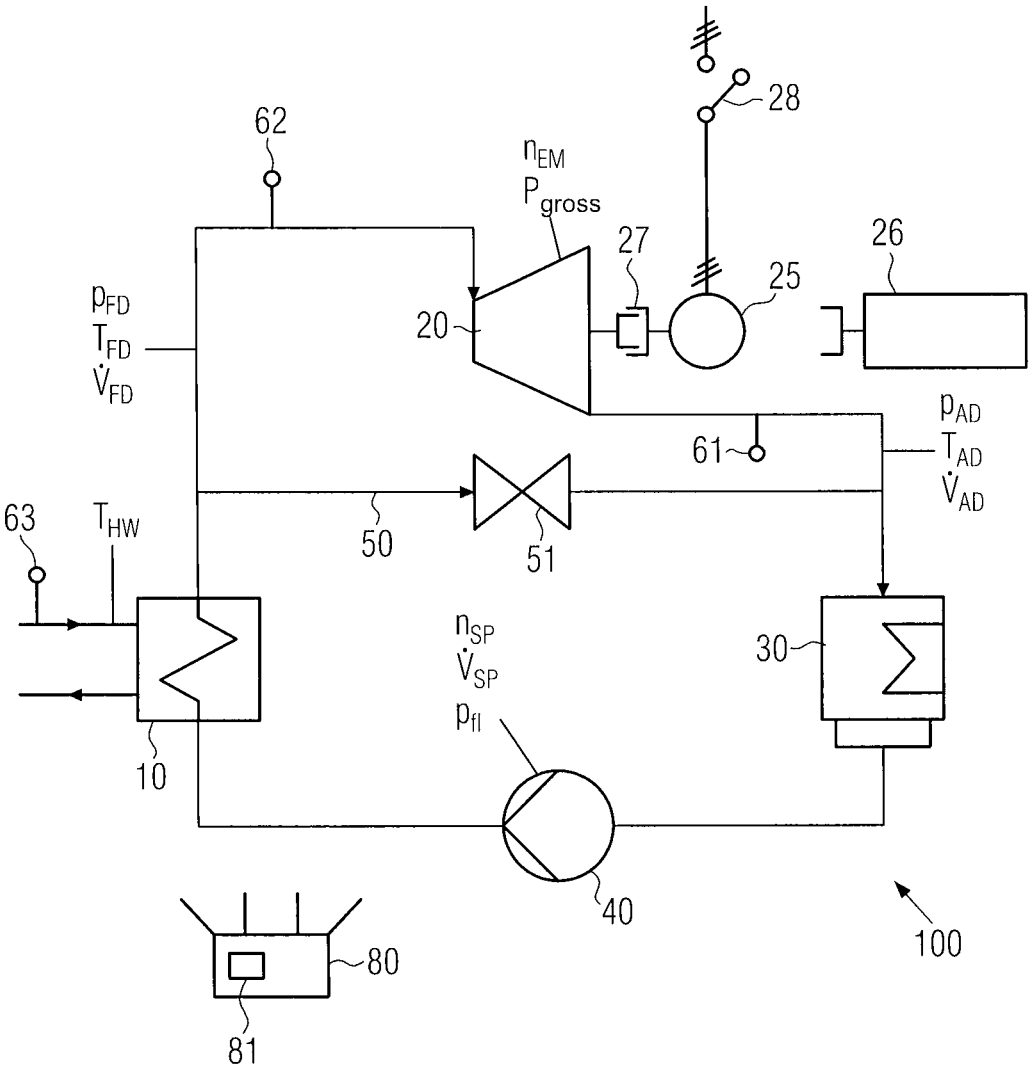
FIG. 1 shows an embodiment of the apparatus according to the invention.

As an example, an ORC process is assumed in the following to be a thermodynamic cycle process. FIG. 1 shows an embodiment 100 of the thermodynamic cycle process apparatus according to the invention. The ORC cycle process comprises a feed pump 40 for increasing pressure, an evaporator 10 for preheating, evaporating and overheating a working medium, an expansion machine 20 for power-generating expansion of the working medium, which is connected with or without coupling 27 to a generator 25 (or a motor/generator unit) or an external process 26, a possible bypass 50 for bypassing the expansion machine 20 and a condenser 30 for heating, condensing and sub-cooling the working medium.

In addition, the cycle process apparatus 100 according to the invention includes an exhaust steam pressure measuring device 61 for measuring an exhaust steam pressure downstream of the expansion machine 20. As an example, the exhaust steam pressure measuring device 61 is provided here between the expansion machine 20 and the condenser 30. However, it is also possible to arrange these between the condenser 30 and the feed pump, if necessary, taking into account a pressure loss in the condenser 30 in the form of a correction value to the measured exhaust steam pressure. As used herein, the terms "steam" and "steam pressure" as used in connection with the thermodynamic cycle process of the present invention comprise "vapor" and "vapor pressure", respectively.

In addition, a control device 80 is provided for setting a volume flow of the working medium pumped by the feed pump 40 (e.g. by setting a rotational speed of the feed pump (40) in accordance with a control model of the thermodynamic cycle process apparatus (100) stored in a storage (81) of the control device (80), only as a function of the measured exhaust steam pressure (corrected by the said correction value) and a target rotational speed of the expansion machine (20) as input variables of the control model and with the volume flow of the feed pump (40) (e.g. in the form of the rotational speed of the feed pump (40) as output variable of the control model.

In the case of coupling a generator 25 (or a motor/generator unit), a coupling switch 28 may also be provided, which couples the generator 25 (or the motor/generator unit) to or uncouples it from a power grid.

The underlying problem of the solution according to the invention is discussed below.

Discussion of the Problem

Figure 2:
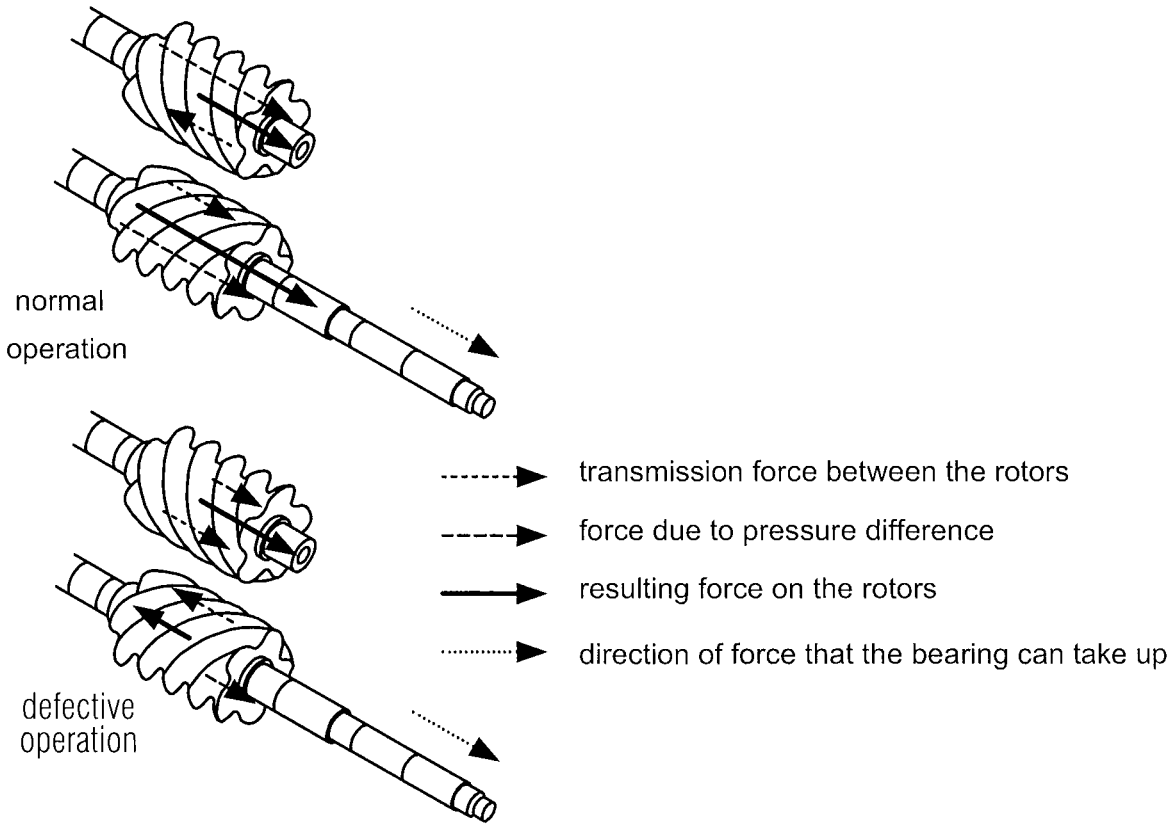
FIG. 2 shows forces in the expansion machine.

The invention is based on the following problem. If the expansion machine is operated by a motor, i.e. power is entered, for example, by the generator 25 in motor operation due to a fixed speed specification or by the external process, there is a risk of damage, since the power flow does not correspond to the design point ("defective operation"). The force direction on the rotors of the expansion machine (as shown in FIG. 2) is determined by the force effect of the pressure position of live steam and exhaust steam (depending on the pressure difference across the expansion machine) and the forces based on the power output or power consumption ("transmission force", depending on the pressure quotient across the expansion machine, see also FIG. 4). At the operating point and thus at the design point of the expansion machine, these are designed in such a way that the resulting force acts in the direction of the force absorption capacity of the bearing arrangement. In the example shown, the expansion machine 20 is a screw expander.

Damage is caused, for example, by abrasion or chip formation due to contact of rotating bodies with the housing, since the force effect is not supported by the bearing (FIG. 2). This can also result in displacement in the axial direction and, under certain circumstances, rotation of the bearing ring due to relief, which can lead to damage to the bearing.

However, this motor operation occurs automatically if the expansion machine is still at a standstill at the switch-on point (present pressure position cannot overcome the necessary post-compression) or the speed is below the switch-on synchronous speed (connection point a) in FIG. 3). In these points the expansion machine is accelerated and power is used for it. The available power of the expander is therefore negative.

For a better understanding, we speak here of post-compression (more precisely: post-compression power) and post-expansion (more precisely: post-expansion power). In principle, however, this is a different part of the ejection process ($P_{AA}$) which has to be applied by the expansion machine to eject the medium at the end of the expansion in the chamber of the expansion machine against the exhaust steam pressure $p_{AD}$. This distinction thus refers to the reference ($P_{AA,ref}$), where the opening pressure of the chamber is equal to the exhaust pressure behind the chamber.

Thus, the following applies:

For $p_{chamber}>P_{AD}$:

$$P_{post\text{-}expansion}=P_{AA;ref}-P_{AA,act};P_{post\text{-}compression}=0$$

For $p_{chamber}<P_{AD}$:

$$P_{post\text{-}compression}=P_{AA;ref}-P_{AA,act};P_{post\text{-}expansion}=0$$

For $p_{chamber}=P_{AD}$:

$$P_{post\text{-}expansion}=0;P_{post\text{-}compression}=0$$

Figure 3:
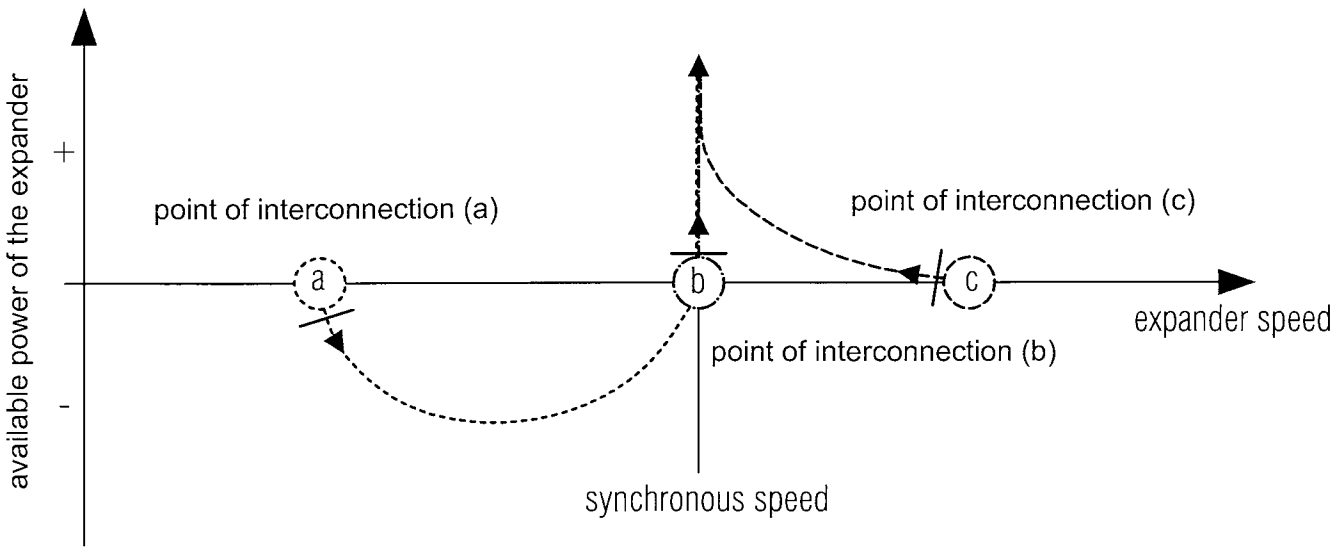
FIG. 3 shows the power of the expansion machine as a function of its speed.

For damage-free connection, the expansion machine must therefore be at least at a neutral power point at connection speed (connection point b) in FIG. 3) or above (connection point c) in FIG. 3), so that the expansion machine is at least not accelerated or braked, and thus at least no negative power is delivered.

Before the generator or external process is connected, no power can be dissipated, i.e. the machine may be accelerated uncontrolled to damage if the steam supply is undefined.

Knowledge of the current expansion machine speed would in principle be possible with the aid of a speed measurement. However, this speed measurement represents an additional cost or is only very costly to implement.

Figure 4:
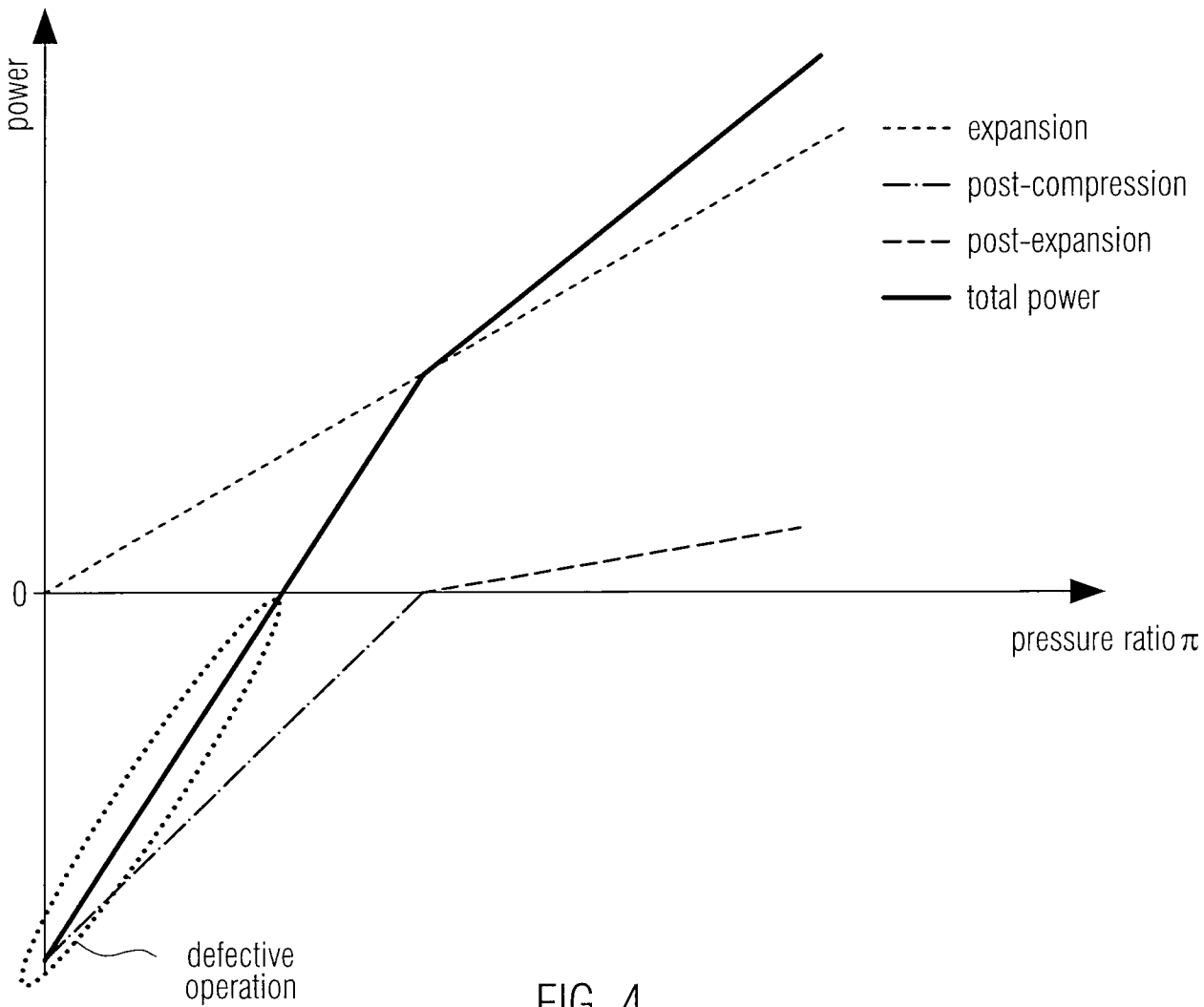
FIG. 4 shows the power of the expansion machine as a function of the pressure ratio.

The defective condition due to power supply to the expansion machine continues to occur during operation and shutdown if the post-compression power exceeds the expansion power due to insufficient pressure positions (see FIG. 4). This leads to an expansion of the gas in the closed expansion chamber of the expansion machine. After opening, however, the pressure in the chamber is below the level of the exhaust side, which is why the expansion machine has to partially compress it again when pushing it out and also push out the medium that has additionally flowed back from the condenser into the chamber ("post-compression"). The following applies:

$$P_{gross}=P_{expansion}+P_{post\text{-}expansion}+P_{post\text{-}compression}$$

The pressure ratio $\pi$ is defined as the ratio of live steam pressure to exhaust steam pressure:

$$\pi=P_{FD}/p_{AD}$$

with $p_{FD}$=live steam pressure $p_{AD}$=exhaust steam pressure

In addition to the directly measurable pressure ratio used here, the volume ratio $\phi$ can also be used instead:

$$\phi=P_{AD}/P_{FD}$$

with $p_{FD}$=live steam pressure $p_{AD}$=exhaust steam pressure

Both ratios ($\pi$, $\phi$) provide the same result in a first approximation.

Inventive Solutions to the Problem

Starting Process

Here, the expansion machine 20 is brought to a defined starting point (speed), which prevents damage to the expansion machine when it is switched on. The necessary measured values of flow rate and speed of the expansion machine, which can be determined by expensive measurement technology, are bypassed by model-based control.

This model-based control is based on the basics of the knowledge of the power-neutral point of the expansion machine (as shown in FIG. 4, it applies: $P_{gross}=0$ and therefore $P_{expansion}=-P_{post\text{-}compression}$). This means that, depending on the exhaust steam pressure $p_{AD}$, a corresponding live steam pressure $p_{FD}$ must be achieved.

Furthermore, the speed at which the expansion machine is operated in this power-free state is determined by the steam volume flow supplied. $\dot{V}_{FD}$ dependent:

$$n_{EM}=\dot{V}_{FD}FD/(V_{chamber}\cdot K)$$

with $n_{EM}$=expansion machine speed of rotation $\dot{V}_{FD}$=live steam volume flow $V_{chamber}$=high pressure chamber volume of the expansion machine K=chamber number per revolution Thus the condition of the expansion machine 20 (in particular its speed) can be clearly determined by knowing the live steam pressure, exhaust steam pressure and live steam volume flow (depending on the desired switch-on speed). The above equation for determining the expansion machine speed initially represents the simplest form and can be further improved in accuracy, e.g. by correction by means of a variable speed leakage volume flow. From the expansion machine speed and the other thermodynamic variables, the electrical power and thus e.g. a state of the thermodynamic cycle can be derived.

However, the measurement of the live steam volume flow is a relatively cost-intensive measurement, which thus has a negative influence on the economic efficiency of the overall system.

From the live steam volume flow it is relatively easy to determine the live steam mass flow, which could also be measured in the liquid phase between feed pump 40 and evaporator 10. However, the necessary measuring instruments (e.g. Coriolis) are also associated with considerable costs.

However, there is also a direct relation between the live steam volume flow and the liquid volume flow conveyed by the feed pump, which can be determined via the densities:

$$\dot{V}_{SP}=\dot{V}_{FD}\cdot P_{FD}/P_{fl}$$

with $\dot{V}_{SP}$=volume flow through the feed pump $\dot{V}_{FD}$=volume flow through the expansion machine $p_{FD}$=density of the live steam through the expansion machine $p_{fl}$=density of the liquid medium in the feed pump It should be noted that the live steam density also depends on the position of the exhaust steam pressure, since it is a function of the live steam pressure (and the live steam temperature). The live steam pressure itself is a function of the exhaust steam pressure in this case of performance-free expansion machine operation. This circumstance ($p_{FD}$ and $\dot{V}_{SP}$) also leads to the fact that a static start behaviour with fixed speed specification of the feed pump depending on the exhaust steam pressure, which depends on the condensation conditions such as e.g. heat sink temperature, can lead to a start process with motor drive (high exhaust steam pressure $p_{AD}$; sub-synchronous to standstill of the expansion machine) or to an acceleration of the expander beyond the permissible speed (low $p_{AD}$).

Furthermore, the necessary pressure difference from the neutral point, which the feed pump 40 has to apply, is given as $$p_{SP}p_{FD}-p_{AD}$$

Thus the volume flow in the feed pump 40 and the pressure difference which the feed pump 40 has to apply are known. By modelling the feed pump 40, a speed point of the feed pump 40 can now be found at which this condition of pressure difference and flow rate is fulfilled.

This results in a start control which assigns a value for the feed pump speed to each exhaust steam pressure and the associated switch-on speed (target rotational speed of the expansion machine 20) without the need for additional measuring points. A disadvantage is that the actual values of these important measured variables are thus represented by a model and actually remain unknown in the system.

However, the following mechanisms can still jeopardize damage-free switching:

1) A failure of the feed pump (cavitation, motor damage etc.) leads to a lower pressure level/flow rate than is required for damage-free operation.

2) A bypass 50 (FIG. 1) which is not closed or not completely closed or other outflow of refrigerant which is not led through the expansion chambers leads to a too low pressure level when switched on.

3) The temperature level of the heat source is below the necessary level to be able to evaporate the working medium at the necessary live steam pressure.

The problems under 1)+2) can be avoided by additionally monitoring the achieved process variable of the live steam pressure upstream of the switch-on process. If the pump and bypass behave regularly, this must correspond to the value determined in the modelling. If it deviates downwards, the start can be aborted without damaging the expansion machine 20.

The problem under 3) is avoided by also storing a model of the necessary heat source temperature ($T_{HW}$, FIG. 1) and only carrying out the start procedure when at least this value necessary for a safe start has been reached or exceeded.

Normal Operation

During operation, very small pressure differences from $p_{FD}$ to $p_{AD}$ can occur if there is no heat supply and poor heat dissipation (e.g. high air temperature/water temperature). It is also possible that this may lead to a faulty operation of the system as shown in FIG. 2 and FIG. 4. Instead of carrying out a gross performance evaluation, which has further influencing factors, the chosen model should be used to monitor the damage-causing drop below the necessary pressure quotient $\pi$ or volume ratio $\phi$ by monitoring the necessary live steam pressure $p_{FD}$ in relation to the exhaust steam pressure. If a critical threshold value is reached here, the system is shut down in a controlled manner before defective states can be reached. Another possibility is to monitor the electrical power of the expansion machine. If this falls below a critical threshold value, the system is shut down in a controlled manner.

Shutdown

In the shutdown program, the temperature position on the heat input side of the system is reduced in the desired manner in order to achieve a safe standstill of the system at moderate temperatures. This lowering, however, reduces the live steam pressure $p_{ED}$ and thus the pressure quotient Tr. In extreme cases, this may also result in faulty operation during shutdown.

To prevent this, the hot water temperature ($T_{HW}$) required for safe operation is also monitored by means of a measuring device 63 and the live steam pressure ($p_{FD}$) by means of a measuring device 62. If the pressure falls below a defined threshold value, the expansion machine is decoupled from the power connection, i.e. neither power is supplied nor discharged, and at the same time the bypass 50 is opened by means of valve 51 in order to reduce the pressure on the live steam side and to allow the system to continue running if necessary. Switching off in relation to a live steam pressure depending on the exhaust steam pressure avoids on the one hand the faulty operation, but on the other hand also that the pressure position is still so high that switching off the expander power connection (decoupling the expansion device) can turn it up uncontrolled before the pressure can be sufficiently reduced via the bypass 50. This safety can be additionally achieved by gradually reducing the feed pump speed to a value corresponding to the zero power point from the modelling. This achieves an operating state in which, in the event of a further control of the expansion machine (of the expander) 20 or of an error in the bypass opening, the expansion machine 20 is operated at a defined speed below a defective speed in a power-neutral manner. Overall, the operating times in the power-neutral range must also be minimised, as the very low bearing load means that operation shortens the service life.

Figure 5:
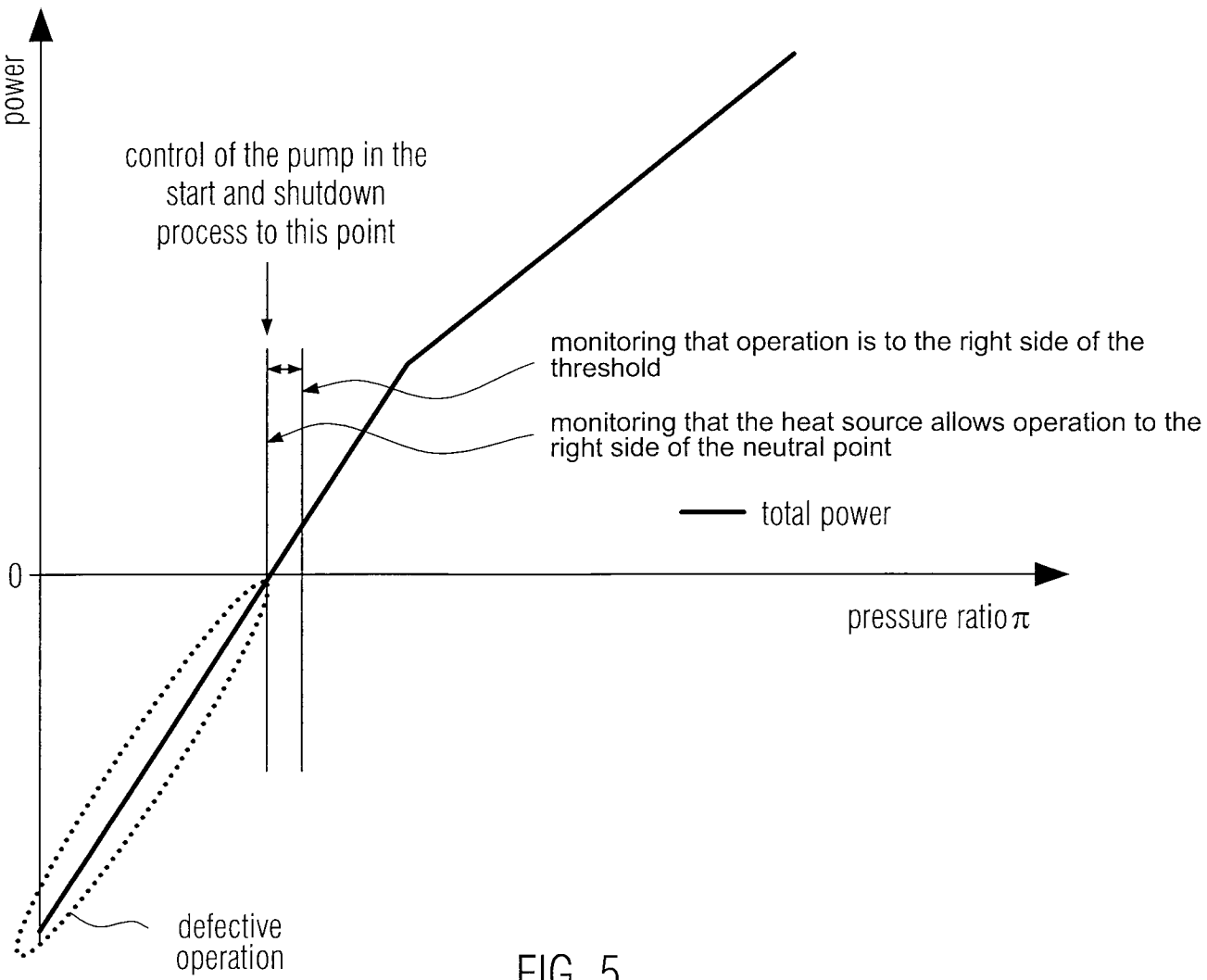
FIG. 5 shows a control process in the power/pressure ratio diagram.

The framework of the control strategy is briefly summarised below and illustrated in FIG. 5:

As a result of the modelling, there is a control device 80 of the feed pump 40, which operates without measured values of the expander speed or the flow rate and contains the low pressure (exhaust pressure) as input variable, in order to control to a target rotational speed of the expansion device 20.

In order to ensure the correct functioning of the feed pump 40 and the bypass 50 (a failure in turn leads to faulty motor operation), the live steam pressure and the hot water temperature from the modelling are also used as monitoring variables (falling below model value means deviation in the system with damage potential).

The embodiments shown are only exemplary and the complete scope of the present invention is defined by the claims.

The invention claimed is:

1. A method for controlling a thermodynamic cycle process apparatus, wherein the thermodynamic cycle process apparatus comprises an evaporator, a vapor expander, a condenser, and a feed pump, and the vapor is operably couplable to an external apparatus during operation, wherein the external apparatus comprises a generator, a generator and motor unit or a device driven by a separate motor, and wherein the method comprises the following steps:

measuring an exhaust vapor pressure downstream of the vapor expander; and setting a volume flow of the feed pump, in accordance with a computer-implemented control model of a control device, as a function of the measured exhaust vapor pressure and a target rotational speed of the vapor expander input variables of the computer-implemented control model and with the volume flow of the feed pump as an output variable of the computer-implemented control model.

2. The method according to claim 1, wherein setting the volume flow of the feed pump includes at least one selected from the group comprising:

setting the speed of rotation of the feed pump;

setting a throttle valve or a 3-way valve behind the pump; and setting a conveying characteristic of the feed pump by setting a guide wheel in the case of a centrifugal pump as the feed pump or by setting a piston stroke in the case of a piston pump as the feed pump.

3. The method according to claim 1, wherein a starting process of the thermodynamic cycle process apparatus comprises the following steps:

controlling, by the computer-implemented control module of the control device, the vapor expander to a state in which the target rotational speed of the vapor expander is greater than or equal to a predetermined speed of the external apparatus to be coupled to the vapor expander; and subsequent to the controlling step, coupling of the vapor expander with the external apparatus.

4. The method according to claim 1, comprising the further steps:

measuring a live vapor pressure upstream of the vapor expander;

comparing the measured live vapor pressure with a current model live vapor pressure according to the computer-implemented control model of the control device; and at least one selected from the group comprising (i) initiating a shutdown process and (ii) aborting the starting process, if the measured live vapor pressure is below the model live vapor pressure by more than a predetermined amount or by more than a predetermined fraction.

5. The method according to claim 4, wherein, during the starting process, the vapor expander is coupled to the external apparatus only if the measured live vapor pressure is greater than or equal to the model live vapor pressure.

6. The method according to claim 3, comprising the further steps:

measuring a heat source temperature of a heat source supplying heat to the thermodynamic cycle process apparatus via the evaporator; and performing the start procedure only if the measured heat source temperature is greater than or equal to a current model heat source temperature according to the computer-implemented control model.

7. The method according to claim 1, further comprising initiating a shutdown process of the thermodynamic cycle process apparatus, the shutdown process comprising the following steps:

decoupling the vapor expander from the external apparatus if at least one selected from the group comprising (i) the live vapor pressure and (ii) the heat source temperature fall below a respective predetermined threshold; and opening a bypass line to bypass the vapor expander.

8. The method according to claim 7, comprising the further step:

reducing the volume flow of the feed pump until a neutral or force-free state of the vapor expander is reached according to the computer-implemented control model, in which the power consumed by the vapor expander is equal to the power output by the vapor expander or the total force acting on the vapor expander in the direction of an axis of rotation of the vapor expander is zero.

9. The method according to claim 1, wherein the computer-implemented control model includes at least one selected from the group comprising analytical, numerical, and tabular relations of the input and output variables.

10. A thermodynamic cycle process apparatus comprising an evaporator, a vapor expander, a condenser, and a feed pump, the vapor expander being operably couplable to an external apparatus during operation, wherein the external apparatus comprises a generator, a generator and motor unit or a device driven by a separate motor; further comprising:

an exhaust vapor pressure measuring device for measuring an exhaust vapor pressure downstream of said vapor expander; and a control device for setting a volumetric flow of the feed pump in accordance with a control model of the thermodynamic cycle process apparatus stored in one or more non-transitory computer readable media of the control device as a function of the measured exhaust vapor pressure and a target rotational speed of the vapor expander as input variables of the control model and with the volumetric flow of the feed pump as output variable of the control model.

11. The thermodynamic cycle process apparatus according to claim 10, wherein the computer readable media of the control device comprising computer-executable instructions for performing the following steps during a starting process of the thermodynamic cycle process apparatus:

controlling the vapor expander to a state in which the target rotational speed of the vapor expander is greater than or equal to a predetermined speed of the external apparatus to be coupled to the vapor expander; and subsequent to the controlling step, coupling of the vapor expander with the external apparatus.

12. The thermodynamic cycle process apparatus according to claim 10 further comprising:

a live vapor pressure measuring device for measuring a live vapor pressure upstream of the vapor expander;

the computer readable media of the control device comprising computer-executable instructions for performing the following steps:

comparing the measured live vapor pressure with a current model live vapor pressure according to the control model, and at least one selected from the group comprising (i) initiating a shutdown process and (ii) aborting a starting process, if the measured live vapor pressure is below the model live vapor pressure by more than a predetermined amount or by more than a predetermined fraction.

13. The thermodynamic cycle process apparatus according to claim 10 further comprising:

a heat source temperature measuring device for measuring a heat source temperature of a heat source that supplies heat to said thermodynamic cycle process apparatus via said evaporator and wherein the control device is configured to perform the starting process only when the measured heat source temperature is greater than or equal to a current model heat source temperature according to the control model.

14. The thermodynamic cycle process apparatus according to claim 10 further comprising:

a bypass line as a direct connection between the evaporator and the condenser for bypassing the vapor expander;

the computer readable media of the control device comprising computer-executable instructions for performing the following steps during a shutdown operation of the thermodynamic cycle process apparatus:

decoupling the vapor expander from the external apparatus if in the event of at least one selected from the group comprising (i) the live vapor pressure falls below a respective predetermined threshold and (ii) the heat source temperature falls below a predetermined threshold; and opening the bypass line by means of a valve in the bypass line.

15. The thermodynamic cycle process apparatus according to claim 10 further comprising at least one selected from the group comprising:

a coupling for coupling the vapor expander to the external apparatus; and a gear for setting a speed ratio from the vapor expander to the external apparatus.

16. The method according to claim 2, wherein a starting process of the thermodynamic cycle process apparatus comprises the following steps:

controlling, by the computer-implemented control module of the control device, the vapor expander to a state in which the target rotational speed of the vapor expander is greater than or equal to a predetermined speed of the external apparatus to be coupled to the vapor expander; and subsequent to the controlling step, coupling of the vapor expander with the external apparatus.

17. The method according to claim 2, comprising the further steps:

measuring the live vapor pressure upstream of the vapor expander;

comparing the measured live vapor pressure with a current model live vapor pressure according to the computer-implemented control model; and at least one selected from the group comprising (i) initiating a shutdown process and (ii) aborting the starting process, if the measured live vapor pressure is below the model live vapor pressure by more than a predetermined amount or by more than a predetermined fraction.

18. The method according to claim 3, comprising the further steps:

measuring the live vapor pressure upstream of the vapor expander;

comparing the measured live vapor pressure with a current model live vapor pressure according to the computer-implemented control model; and at least one selected from the group comprising (i) initiating a shutdown process and (ii) aborting the starting process, if the measured live vapor pressure is below the model live vapor pressure by more than a predetermined amount or by more than a predetermined fraction.

19. The method according to claim 4, comprising the further steps:

measuring a heat source temperature of a heat source supplying heat to the thermodynamic cycle process apparatus via the evaporator; and performing the start procedure only if the measured heat source temperature is greater than or equal to a current model heat source temperature according to the computer-implemented control model.

20. The method according to claim 5, comprising the further steps:

measuring a heat source temperature of a heat source supplying heat to the thermodynamic cycle process apparatus via the evaporator; and performing the start procedure only if the measured heat source temperature is greater than or equal to a current model heat source temperature according to the computer-implemented control model.

* * * * *